United States Patent [19]

Clark

[11] Patent Number: 4,768,789

[45] Date of Patent: Sep. 6, 1988

[54] DART BOARD ASSEMBLY FOR AN ELECTRONIC DART GAME

[76] Inventor: Richard D. Clark, 801 Fitch Rd., Rockford, Ill. 61109

[21] Appl. No.: 47,985

[22] Filed: May 7, 1987

[51] Int. Cl.[4] ..... F41J 3/00

[52] U.S. Cl. ..... 273/371; 273/398; 273/408; 273/416

[58] Field of Search ..... 273/371, 348, 373, 377, 273/398, 408, 416, 1 E

[56] References Cited

U.S. PATENT DOCUMENTS

| | | | |
|---|---|---|---|
| 3,602,510 | 8/1971 | Knippel | 273/371 |
| 4,057,251 | 11/1977 | Jones et al. | 273/95 R |
| 4,516,781 | 5/1985 | DeVale et al. | 273/373 |
| 4,635,940 | 1/1987 | Kelley | 273/347 |

FOREIGN PATENT DOCUMENTS

| | | | |
|---|---|---|---|
| 2137516 | 10/1984 | United Kingdom | 273/371 |

OTHER PUBLICATIONS

"Project 'Arachnid', Report on Pre-University Course Project", British Aircraft Corporation Ltd., Document No. ESS/SS/534, Dec. 1973.

*Primary Examiner*—Leo P. Picard
*Assistant Examiner*—Jessica Harrison
*Attorney, Agent, or Firm*—Fitch, Even, Tabin & Flannery

[57] ABSTRACT

A dart board assembly for use in an electronic dart game. The assembly includes an electrically insulative dart board for catching and releasably holding darts. The dart board includes a spider defining a bull's -eye and a plurality of scoring radials extending from the bull's -eye. The assembly further includes an electrically insulative sensor board positioned adjacent to and aligned with the dart board. The sensor board includes a number of electrically conductive detectors with one detector being positioned in alignment with each of the scoring radials in the bull's-eye. The sensor board also includes an electrically conductive shield surrounding each of the detectors and electrically insulated from each of them. The shield is grounded to prevent cross talk between the detectors. A method of using the dart board assembly of the present invention is also disclosed.

13 Claims, 5 Drawing Sheets

DART BOARD ASSEMBLY FOR AN ELECTRONIC DART GAME

The present invention relates to amusement equipment and, more particularly, to an improved dart board assembly for an electronic dart game.

BACKGROUND OF THE INVENTION

Electronic dart games have become increasingly popular for commercial amusement purposes. Heretofore, such games typically included dart board assemblies having a number of slidable apertured target segments held in a frame for striking a switch array in response to being hit by a blunt nosed dart. The various switches are interconnected with electronic scoring and readout circuitry which monitors closing of the various switches associated with each target segment. These games are often subjected to frequent and severe use. Improvements in ruggedness and reliability are always desirable for such applications.

In one prior art electronic dart game, the target segments were in the form of cups having a closed end wall and the apertured target plate was cemented in, and spaced from the open end of the cup. Such target segments, while performing generally satisfactorily, retained broken dart tips, were susceptible to becoming jammed in the frame upon being struck near the perimeter of the target plate and were relatively expensive to manufacture.

In another electronic dart game, the target segments each had closed side walls extending rearwardly from the target plate to form an enclosed space behind the target plate. A number of rectangular protuberances were disposed on the rear surface of the side walls. The frame for the segments had walls defining target segment spaces, with the walls having guide ribs for engaging the side wall of the segment intermediate the peripheral corners of the target plate. This portion of the side wall was very flexible and a dart striking near the periphery of the plate could cause the segment to become jammed in the frame.

The various switches were typically contained in a switching matrix of laminated construction including layers having aligned contacts spaced by a thin layer of insulation having holes aligned with each pair of contacts. A dart striking a target segment caused its rearward shifting pushing a contact through the associated hole to engage the other of the pair of contacts to close a circuit. The scoring matrix could be covered with a resilient sheet functioning to bias the various target segments away from the scoring matrix.

These prior art games having moving target segments performed generally satisfactorily. However, the moving segments were subject to wear and could jam, resilient material becomes brittle with age so as to lose the ability to return the segments to their extended positions, and electrical contacts become worn with repeated use. For further information regarding the structure and operation of such prior art electronic dart games, reference may be made to U.S. Pat. Nos. 4,057,251 and 4,516,781 and U.S. patent application Ser. No. 749,584, now U.S. Pat. No. 4,635,940.

SUMMARY OF THE INVENTION

Among the several aspects and features of the present invention may be noted the provision of an improved dart board assembly for an electronic dart game. The target segments are not required to move because sensing of a dart is achieved by detecting the electrostatic charge on the dart. The dart board assembly of the present invention emulates the switching of contacts of prior art dart board assemblies so that the electronic scoring and readout circuitry and programming for those prior art dart assemblies is usable with the new dart board assembly. The present dart board assembly is usable with both lightweight blunt shaft safety darts and standard weight darts having metal shafts. The dart board assembly of the present invention is rugged and reliable in use, has long service life, and is relatively easy and economical to manufacture. Other aspects and features will be in part apparent and in part pointed out hereinafter in the following specification and accompanying drawings.

Briefly, the dart board assembly of the present invention includes an electrically insulative dart board for catching and releasably holding darts. The board includes a frame or spider defining a bull's-eye and a number of scoring radials extending from the bull's-eye. The assembly also includes an electrically insulative sensor board disposed adjacent to and aligned with the dart board with an electrically conductive detector carried by the sensor board in alignment with each of the scoring radials and the bull's-eye. The sensor board also has a shielding pattern surrounding and insulated from each of the detectors. Preferably, the shield is grounded to eliminate cross talk among the various detectors.

As a method, the present invention includes the steps of:

(a) electrically charging a dart thrown at the dart board;

(b) detecting the electronic redistribution occasioned on the detector aligned with the target segment receiving the charged dart; and (c) emulating the switching of a pair of contacts between an open-circuit condition and a closed-circuit condition in response to detection of the charged dart.

BRIEF DESCRIPTION OF THE DRAWINGS

Corresponding reference characters indicate corresponding components throughout the several views of the drawings.

DESCRIPTION OF THE PREFERRED EMBODIMENT

Figure 1:
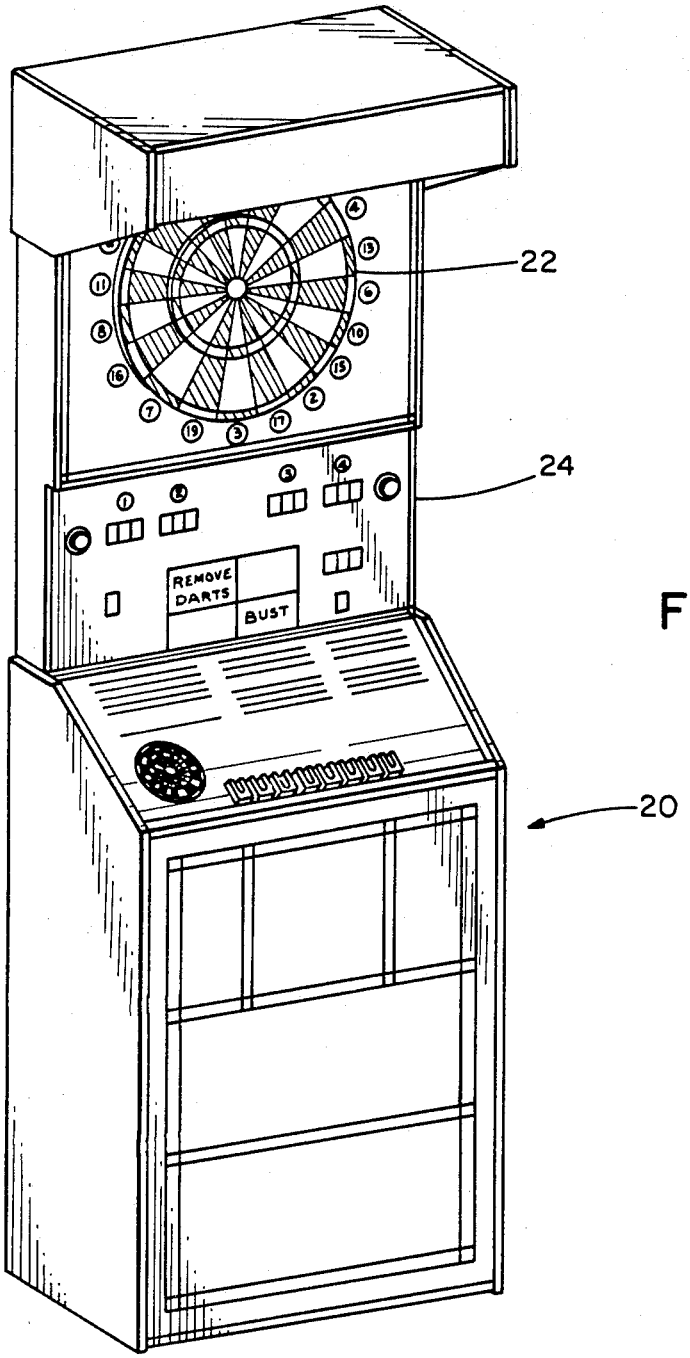
FIG. 1 is a perspective view of an electronic dart game including a dart board assembly embodying various features of the present invention.
Figure 2:
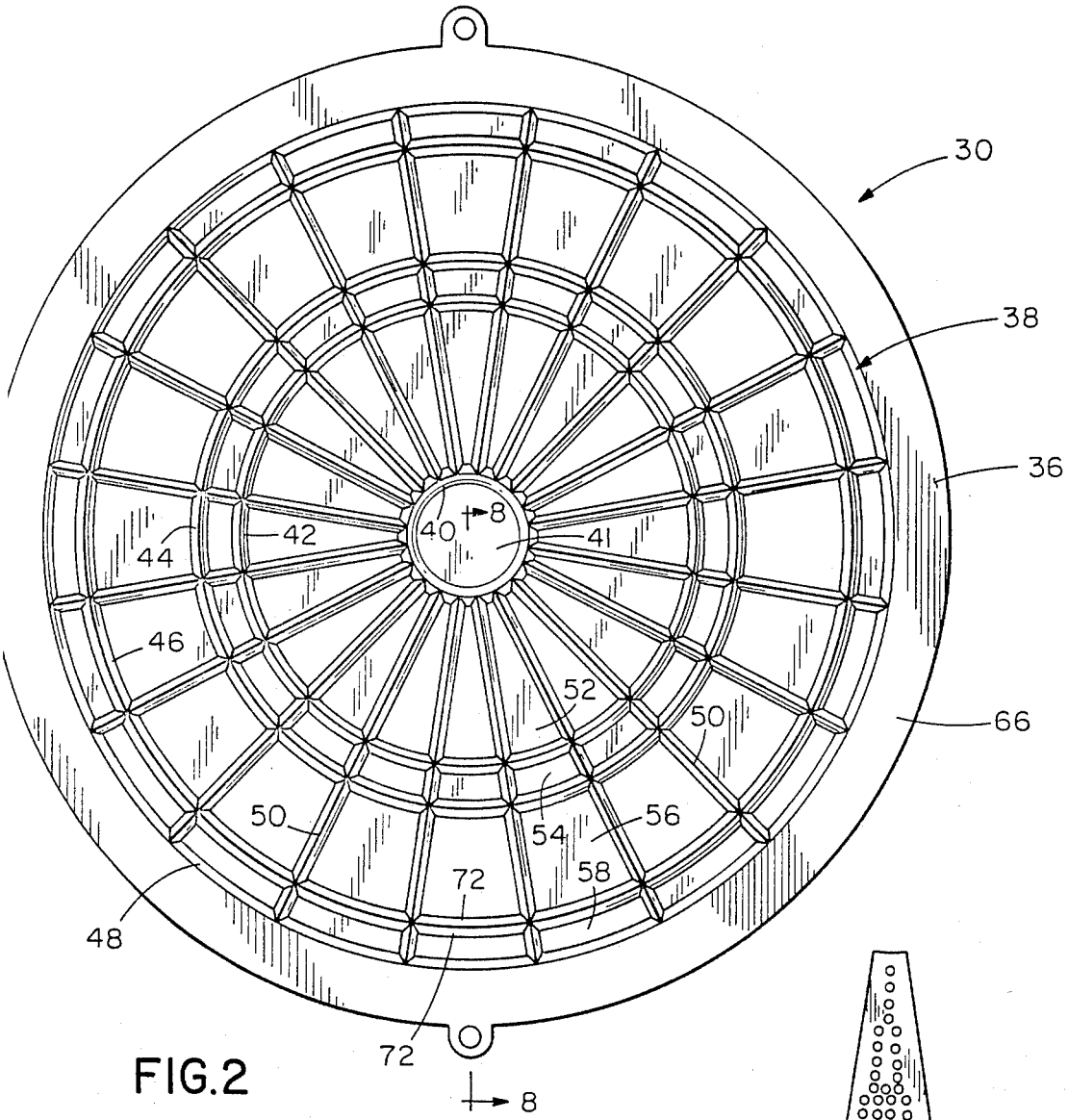
FIG. 2 is a front elevational view showing the outer surface of a dart board having a frame defining a bull's-eye and a plurality of scoring radials extending from the bull's-eye.
Figure 8:
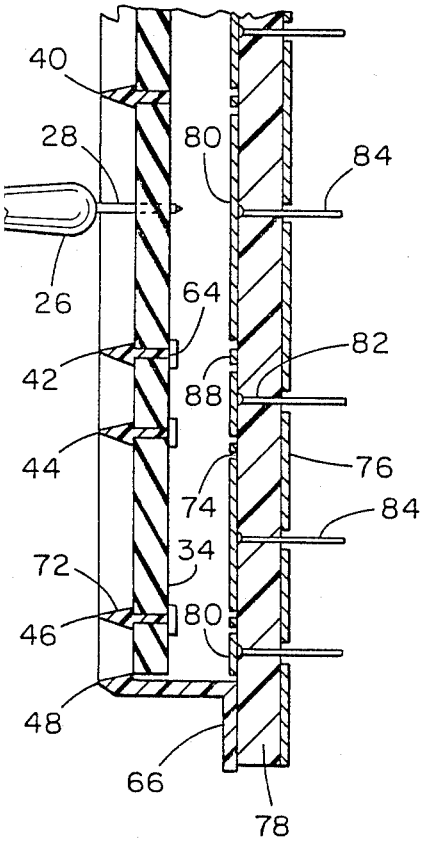
FIG. 8 is a sectional view of the assembly of the dart board with the sensor board aligned therewith, taken generally along line 8—8 of FIG. 2.

Referring now to the drawings, a dart board assembly embodying various features of the present invention for use in an electronic dart game 20, is generally indicated by reference numeral 22 in FIG. 1. The dart game 20 includes a housing 24 enclosing electronic circuitry for automatic scoring and providing readouts, as well as providing other functions. The housing has various controls and selectors for use by the players. Additionally, the dart game has a frame holding a support (not shown) for attachment of the board assembly 22. Such automatic scoring and readout circuitry and controls are well known to those of skill in the art and do not form a part of the present invention. As will appear more fully hereinafter, the dart board assembly 22 provides electrical signaling to the circuitry. The assembly is for use with darts 26 (shown in FIG. 8) having shafts 28 which may be made of relatively soft material with blunt ends to greatly lessen any chance of injury to a person or object struck by a dart. The darts are made, at least partially, of insulative material.

The dart board assembly 22 includes a dart board 30 defining a bull's-eye and a number of scoring radials extending from the bull's-eye. A sensor board 32 is held adjacent to and in alignment with the dart board and includes a detector for each scoring radial and the bull's-eye. In sharp contrast to prior art electronic dart games such as shown in U.S. Pat. Nos. 4,057,251 and 4,516,781 where movable target segments are used to close contacts to indicate the striking of a dart, the dart board 30 has no moving parts. As will be discussed more fully hereinafter, the sensor board 32 detects the small electrostatic charge acquired by the dart as a result of its flight to and/or its capture by the dart board.

More specifically, the dart board 30 is made of electrically insulative material, such as plastic, and includes an inner surface 34 facing the sensor board 32 and an outer surface 36 facing the player(s). The dart board includes a frame or spider 38 having an annular central wall 40, defining the bull's-eye space 41, and first, second and third intermediate circular walls, 42, 44, and 46, respectively, and a peripheral wall 48 all of which are concentric with central wall 40. Twenty regularly spaced radial walls 50 interconnect the central wall 40 and the peripheral wall 48, and together define twenty scoring radials, extending from the bull's-eye, to which different scoring values are assigned, as shown in FIG. 1. The intermediate walls 42, 44, 46 divide each scoring radial into an inner pie-shaped portion 52, a triple portion 54, a single portion 56, and an outer double portion 58.

Figure 4:
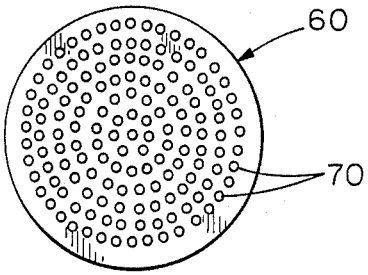
FIG. 4 is a front elevational view of a bull's-eye target segment.
Figure 5:
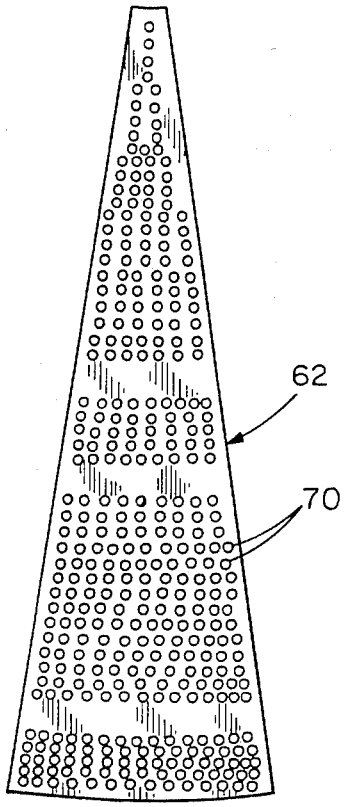
FIG. 5 is a front elevational view of a radial target segment.
Figure 3:
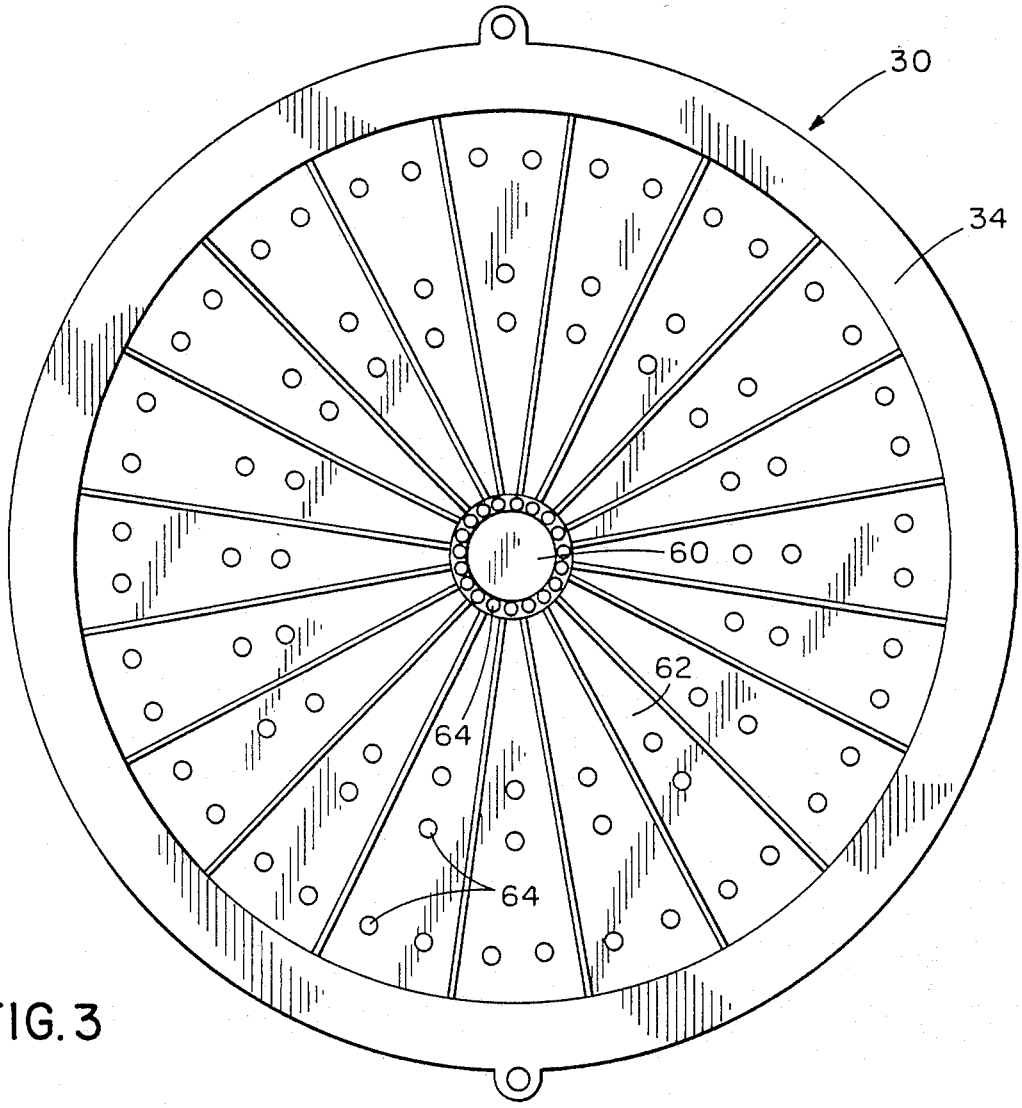
FIG. 3 is a rear elevational view of the dart board of FIG. 2.

The dart board 30 also includes a bull's-eye target segment 60 (FIG. 4) in space 41, and a number of radial target segments 62 (FIG. 5) occupying each of the scoring radials. As best shown in FIG. 3, the various segments are firmly attached to walls 40, 42, 44, 46 and 50 by pins 64 so that the dart board has no moving parts. The peripheral wall 48 preferably extends inwardly beyond the target segments and has a skirt 66 carrying indication of the point value assigned to each scoring radial. Each target segment has a target plate 68 having a great plurality of closely spaced apertures 70 for receiving the dart shafts.

The apertures 70 converge in the direction of the inner surface 34 and are proportioned to receive and wedge the bluntly pointed shaft 28 of a dart 26 but to prevent a broken shaft from passing through the target plate. By way of example, each aperture could converge from a diameter of 0.075" adjacent the outer end 36 of the frame 38, to a diameter of about 0.060". This feature has the advantage that, while broken shafts cannot pass through the target plate, upon periodic dismounting of the board 30, any broken shafts can be dislodged from a target segment by using a tool with a small diameter shaft to push the broken shafts back through the entry side of the target plate. Each of the apertures has a chambered or guide entry surface with entry surfaces of adjacent apertures merging so that a dart striking the apertured field of the target plate is highly likely to have its shaft guided into and retained by one of the apertures 70 due to wedging. Each of the walls making up the frame 38 has inclined sides 72 so that a dart striking a wall is deflected into the apertured field of one of the target plates.

Figure 6:
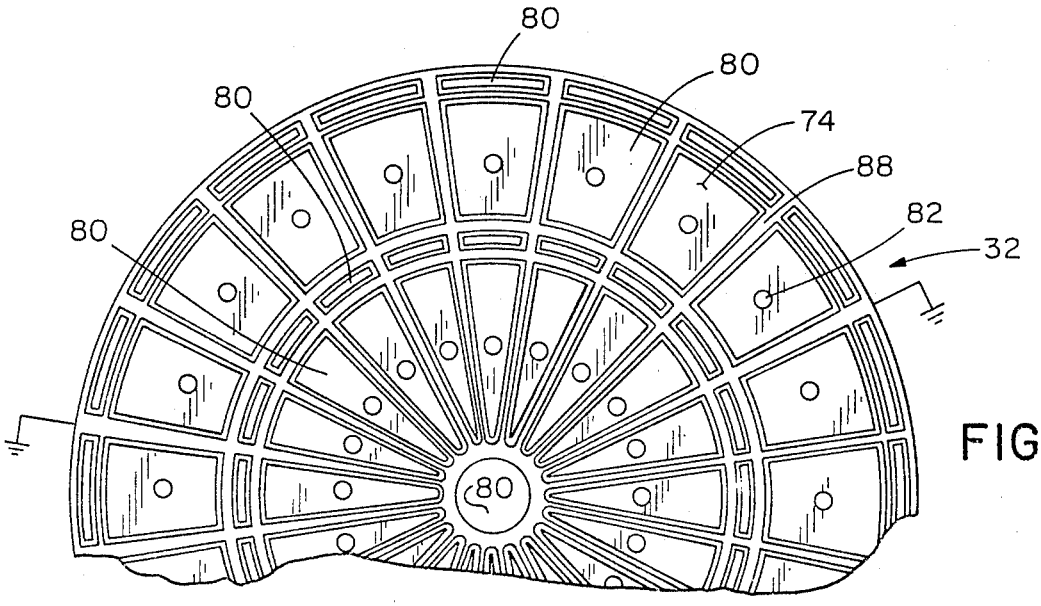
FIG. 6 is a front elevational view showing the outer surface of a sensor board having a plurality of conductive lands and which is held in alignment with the dart board.
Figure 7:
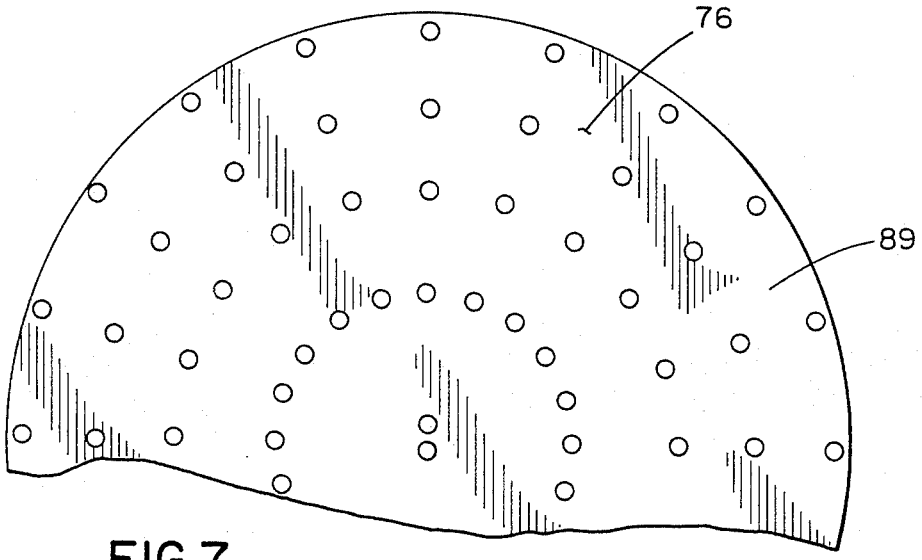
FIG. 7 is a rear elevational of the sensor board of FIG. 6.

The sensor board 32, which is essentially a printed circuit board, is best shown in FIGS. 6 and 7 and includes an outer surface 74 facing the inner surface 34 of the dart board, and an inner surface 76. The board 22 has an insulative base 78 (best shown in FIG. 8) with a plurality of conductive lands 80, one land being shaped similar to and aligned with each of the scoring radial portions, disposed on the outer surface 74.

Figure 9:
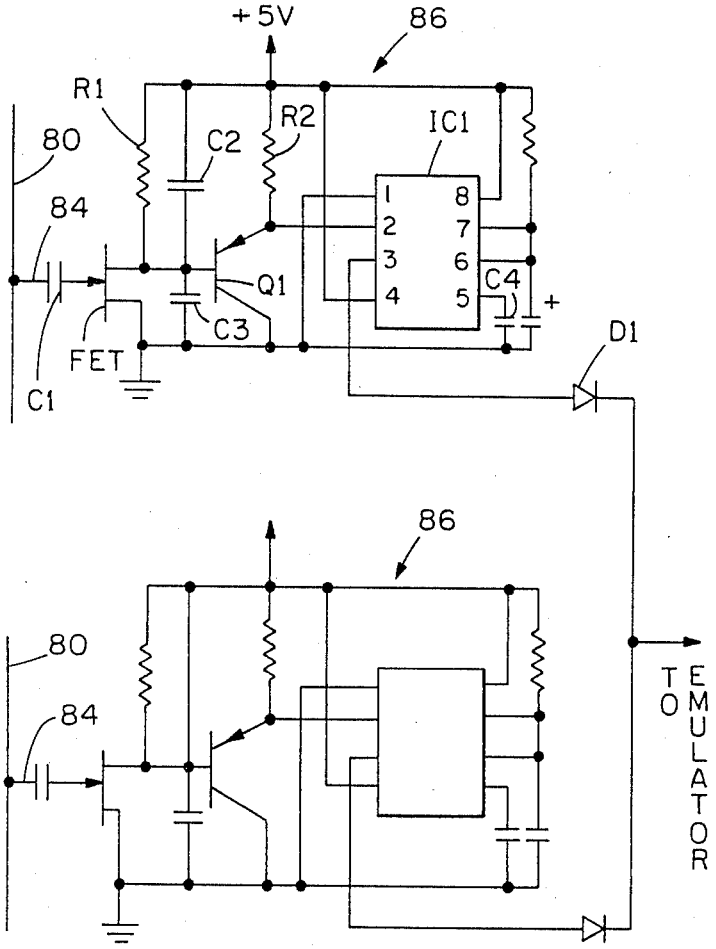
FIG. 9 is a schematic diagram of an amplifier circuit connected to each of the conductive lands.

An aperture 82 extends through the base and intersects each land with a metallic pin 84 disposed in each aperture, connected to its corresponding land 80 and extending beyond the sensor board inner surface for connection to an amplifier circuit 86 shown in FIG. 9. An electrically conductive shield 88 formed by a pattern of stripes, matching the configuration of the frame walls, surrounds and is insulated from each land 80. The shield 88 is grounded to prevent cross talk among the lands 80. The inner surface 76 of the sensor board is preferably covered by a grounded metallic layer 89 except for insulated areas surrounding each of the pins 84.

It is believed that when the dart 26 is thrown at the assembly 22, during the course of its flight and/or capture by the dart board 30, the dart acquires a small charge. This is believed most likely due to the triboelectric effect, the most familiar example of which is the electrification of hard rubber upon being rubbed with fur. There is friction between the constituents of the atmosphere and the flying dart and between the dart shaft 28 and the material forming the aperture receiving the shaft. The charged shaft upon approaching and being captured by a target segment is electrostatically coupled to the corresponding land 80 of the sensor board resulting in the attraction or repulsion of electrons. The resulting momentary redistribution of electrons in the land and connected pin 84 causes a small signal to be developed at the distal end of the pin which serves as the input for the associated amplifier circuit 86.

One of the advantages of the dart board assembly 20 of the present invention is that it emulates the switching of contacts between an open circuit condition and a closed circuit condition in response to a dart hitting a portion of a scoring radial. Thus, dart board assembly 20 can be used with existing automatic scoring and readout circuitry and software therefor which was designed for a dart board assembly having shiftable target segments which moved to close a set of contacts in response to being struck by a dart.

For example, in the switching matrix configuration (comprising the various sets of contacts closed by movement of target segments) used in the electronic dart game made by Nomac Ltd. of Algonquin, Ill., sixteen output lines are provided to the mother board from the switching matrix and four sequentially energized strobe lines are provided from the mother board to the switching matrix. In the parallel data entry system employed, it is the combination of which of the strobe lines is energized and which of the sixteen output lines that supplies a signal, which together supply sufficient information to the scoring circuitry (which forms no part of the present invention) to enable it to provide the appropriate score. The two single segments of each scoring radial are made common so that there are three multipliers for each of the twenty scoring radials. Counting the scoring value for the bull's-eye, the sixty-one scoring possibilities can easily be accommodated by sixteen outputs and four strobes which offer sixty-four combinations. In the actual connections, for example, the output contacts of each of the sets of contacts associated with the double target segments for the 1, 8, 13 and 19 scoring radials are connected to output line 6. Each of the input contacts for the sets of contacts for those segments is connected to a different strobe line.

It is believed that when a dart strikes a movable segment causing it to shift to close its associated set of contacts, those contacts remain closed about 50 ms. The four strobe lines are controlled to completely scan the switching matrix about every 10 ms. so that the closure of a set of contacts is not missed.

Referring to FIG. 9, an amplifier 86 is connected to the pin 84 of each land 80, with the amplifier preferably being mechanically supported by the sensor board 32. Many types of high gain amplifiers could be employed. The preferred amplifier shown includes a field effect transistor FET, which could be part number MPF102, having its gate connected to the pin 84 through a coupling capacitor C1. Its drain is grounded while its source is connected to +5 v through a load resistor R1 in parallel with a capacitor C2. The source is also connected to the base of a PNP transistor Q1, which could be part number 2N3906, with its collector grounded and its emitter connected to +5 v through a load resistor R2. The base-collector circuit of transistor Q1 is paralleled by a transient suppression capacitor C3. The emitter of transistor Q1 is also connected to the trigger pin of an IC timing circuit IC1, which could be part number LM555. The duration of the output of the timing circuit on pin 3 is determined by the value of the timing capacitor C4 connected to control pin 5. The value of this capacitor is chosen so that the output signal remains about 50 ms. FIG. 9 shows two amplifiers which are connected to the two single value lands 80 for a scoring radial. The outputs of the two amplifiers are OR'ed together using small signal diodes D1, which could be part number IN914.

Figure 10:
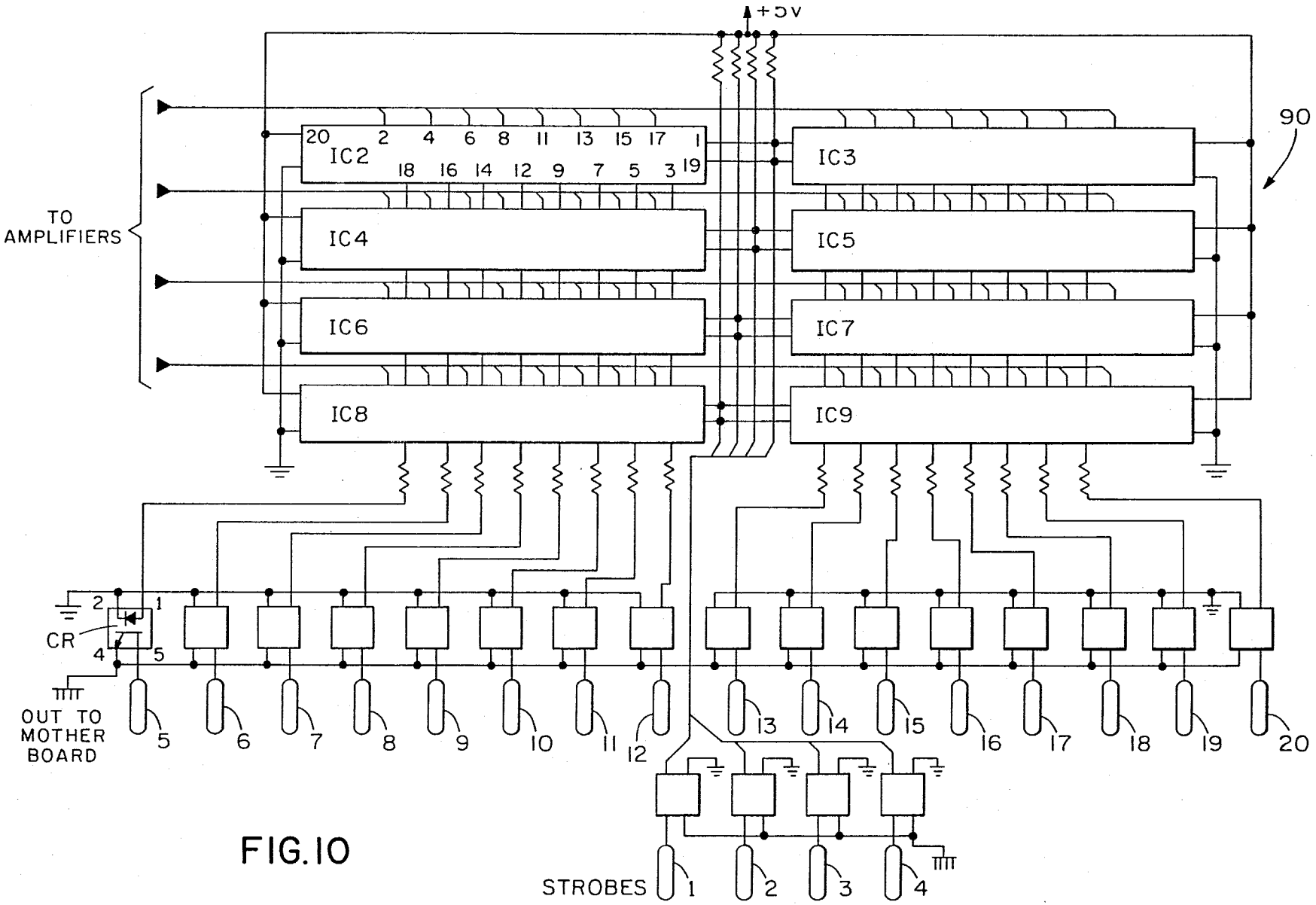
FIG. 10 is a schematic diagram of an emulator circuit interconnecting the amplifiers with the existing scoring and readout circuitry of an electronic dart game.

Referring to FIG. 10, a switch matrix emulator 90 is shown which is formed of 8 octal bus drivers IC2–IC9, which could be part number 74LS244. The 8 drivers are arranged in pairs with the control inputs (1, 19) of each pair connected to receive a different one of the 4 strobe signals provided by the existing scoring circuitry. Each of the amplifiers 86 (or OR'ed amplifiers) is connected to a different input of one of the bus drivers. A corresponding output of each of the four pairs of bus drivers is commonly connected to each of the sixteen outputs to the existing mother board. The total of twenty connections to the existing mother board is each provided with an opto-isolator, which could be part number 4N28.

When strobe line 1 is energized, a signal appearing at an input of the pair of bus drivers IC8 and IC9 is transferred over one of the sixteen outputs to the mother board. The same is true for the control of IC6 and IC7, IC4 and IC5, and IC2 and IC3 by strobe lines 2, 3 and 4, respectively. As the amplifiers provide their outputs for about 50 ms and the sequential strobe signals scan the switch matrix emulator about every 10 ms., a dart striking a scoring portion of a scoring radial is detected and the appropriate score recorded by the existing scoring circuitry. Of course, the existing software prevents multiple scoring for the same dart by preventing counting of the same amplifier signal within, for example, 100 ms.

Operation of the dart board assembly of the present invention is believed as follows: As the thrown dart travels toward the dart board assembly 22, it picks up a small electrostatic charge which, as the dart approaches the board 30, causes a transient redistribution of the electrons in the metallic land 80 underlying the portion of the scoring radial hit by the dart. The pin 84 connected to that land provides a signal to the gate of the FET causing it to conduct, resulting in a low signal at the base of transistor Q1. This turns on transistor Q1 causing a falling waveform to appear at the trigger of IC1, resulting in its provision of an output signal at its output pin 3 which remains for about 50 ms. It has been found that the small charge on the dart quickly dissipates and the transient movement of electrons in the land settles, so that a second dart thrown a short time later and hitting the same portion of the same scoring radial also results in scoring.

While the darts have been described as being of an insulative plastic construction and the target segments as having apertured plastic target plates, it should be noted the sensor board 32 of the present invention is believed usable with a conventional dart board of cork or bristle construction, thus permitting the use of darts with steel shafts. As long as the darts are made at least partially of insulative material they will pick up a static charge in flight. The charged insulative part will attract or repel electrons in the adjacent portion of the steel shaft. This will cause an opposite polarity charge at the tip of the shaft which will cause a redistribution of the electrons in the aligned land of the sensor board which is detected.

As a method of using a dart board assembly for an electronic dart game, and a plurality of darts each dart being formed at least partially of an electrically insulative material, the present invention includes several steps:

(1) a dart thrown at the board is electrostatically charged;

(2) the electronic redistribution occasioned on the land aligned with the target segment receiving the dart is detected; and (3) the switching of a pair of contacts between an open-circuit condition and a closed-circuit condition is emulated in response to detection of the charged dart.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A dart board assembly for use in an electronic dart game, said assembly comprising:

electrically insulative dart board means for catching and releasably holding darts, said board means having an outer surface and an inner surface;

spider means disposed adjacent said board means outer surface and defining therewith a bull's-eye and a plurality of scoring radials extending from said bull's-eye;

electrically insulative sensor board means disposed adjacent to and aligned with said dart board means and having an outer surface facing the inner surface of said dart board means;

a plurality of electrically conductive detector means carried by said sensor board means with one detector means being in alignment with each of said scoring radials and said bull's-eye;

electrically conductive shielding means carried by said board means surrounding each of said detector means and electrically insulated from each of said detector means; and means for holding said shielding means at a predetermined voltage whereby an electrically charged dart caught by the bull's-eye or a scoring radial causes a redistribution of electrons of the detector means aligned therewith.

2. A dart board assembly as set forth in claim 1 further comprising an amplifier for each of said detector means, said amplifier having an input and an output with the input of each amplifier being connected to its associated detector means, said sensor board means carrying the amplifiers.

3. A dart board assembly as set forth in claim 1 wherein each of said detector means comprises a metallic land disposed on said outside surface of said sensor board means.

4. A dart board assembly as set forth in claim 3 wherein said sensor board means has an inside surface and a through aperture aligned with and intersecting each metallic land, each said detector means further comprising a metallic pin connected to its corresponding metallic land, extending through the corresponding aperture and terminating beyond said inside surface of said sensor board means.

5. A dart board assembly as set forth in claim 4 wherein said shielding means comprises a metallic stripe pattern matching the configuration of said spider means and disposed on said outside surface of said sensor board means, said means for holding said shielding means at a predetermined voltage comprising means for grounding said stripe pattern.

6. An assembly as set forth in claim 5 wherein said shielding means further comprises a metallic layer substantially covering said inside surface of said sensor board means except for areas surrounding each of the pins.

7. An assembly as set forth in claim 1 wherein said sensor board means, said plurality of detector means and said shielding means constitute a printed circuit board.

8. An assembly as set forth in claim 1 wherein said spider means comprises a frame of integral plastic construction having a generally annular central wall defining the bull's-eye, a peripheral circular wall concentric with said central wall and a plurality of regularly spaced radial walls interconnecting said central wall and said peripheral wall.

9. An assembly as set forth in claim 8 wherein said dart board means comprises a plurality of target segments of integral plastic construction, one of said target segments being disposed between each pair of adjacent radial walls, each target segment including a target plate having a great plurality of closely spaced apertures for receiving the shaft of a dart.

10. An assembly as set forth in claim 9 further comprising means for non-movably attaching said target segments to said frame.

11. In combination, a dart board assembly for use in an electronic dart game, and a plurality of darts each having a shaft and formed, at least partially, of electrically insulative plastic material, said dart board assembly comprising:

an electrically insulative dart board without relatively moving parts having an outer surface and an inner surface and including a frame defining a bull's-eye and a plurality of scoring radials extending from the bull's-eye, and a target segment means occupying each of said scoring radials and said bull's-eye for releasably holding said darts; and a printed circuit board disposed adjacent to and aligned with said inner surface of said dart board, said printed circuit board including an insulative substrate, a plurality of spaced metallic lands on said substrate with one land aligned with each target segment, and an electrically conductive shield surrounding and insulated from each of said lands.

12. A combination as set forth in claim 11 wherein said frame includes means dividing each scoring radial into portions, said printed circuit board having a discrete land aligned with each portion of each scoring radial.

13. A method of using a dart board assembly for an electronic dart game, and a plurality of darts each dart formed, at least partially, of an electrically insulative material, said dart board assembly comprising:

an electrically insulative dart board without moving parts having an outer surface and an inner surface and including a frame defining a bull's-eye and a plurality of scoring radials extending from the bull's-eye, and a target segment means occupying each of said scoring radials and said bull's-eye for releasably holding said darts; and a printed circuit board disposed adjacent to and aligned with inner surface of said dart board, said printed circuit board including an insulative substrate, a plurality of spaced metallic lands on said substrate with one land aligned with each target segment, and an electrically conductive grounded shield surrounding and insulated from each of said lands, said method comprising the following steps:

(a) electrically charging a dart thrown at said board;

(b) detecting the electronic redistribution occasioned on the land aligned with the target segment receiving the charged dart; and (c) emulating the switching of a pair of contacts between an open-circuit condition and a closed-circuit condition in response to detection of the charged dart.

* * * * *